US009003682B2

(12) United States Patent
Garfinkle et al.

(10) Patent No.: US 9,003,682 B2
(45) Date of Patent: Apr. 14, 2015

(54) ADJUSTABLE SIGN HOLDER DEVICE

(76) Inventors: Benjamin L. Garfinkle, Piedmont, CA (US); Manu Makhija, Castro Valley, CA (US)

( * ) Notice: Subject to any disclaimer, the term of this patent is extended or adjusted under 35 U.S.C. 154(b) by 344 days.

(21) Appl. No.: 12/122,888

(22) Filed: May 19, 2008
(Under 37 CFR 1.47)

(65) Prior Publication Data

US 2009/0165346 A1 Jul. 2, 2009

Related U.S. Application Data

(60) Continuation-in-part of application No. 11/888,108, filed on Jul. 31, 2007, now Pat. No. 8,220,189, which is a continuation of application No. 10/147,669, filed on Jul. 22, 2002, which is a division of application No. 09/684,726, filed on Oct. 6, 2000, now Pat. No. 6,530,166.

(51) Int. Cl.

| | |
|---|---|
| ***A47G 1/16*** | (2006.01) |
| ***G09F 15/00*** | (2006.01) |
| ***G09F 7/20*** | (2006.01) |
| ***G09F 7/18*** | (2006.01) |
| ***G09F 7/10*** | (2006.01) |
| ***G09F 7/22*** | (2006.01) |

(52) U.S. Cl.
CPC .. *G09F 7/18* (2013.01); *G09F 7/10* (2013.01); *G09F 7/22* (2013.01); *G09F 15/0056* (2013.01)

(58) Field of Classification Search
CPC ..... G09F 1/18; G09F 7/10; G09F 7/22; G09F 15/0056
USPC ..... 40/607.04, 606.15, 606.16, 606.19, 40/606.14, 607.11–607.13; 248/407, 408, 248/558, 447.1, 447.2, 126
See application file for complete search history.

(56) References Cited

U.S. PATENT DOCUMENTS

| | | | | |
|---|---|---|---|---|
| 958,082 | A * | 5/1910 | Bland | 40/606.13 |
| 1,606,369 | A * | 11/1926 | Johnston | 248/457 |
| 4,134,222 | A * | 1/1979 | Orsos | 40/606.15 |
| 4,134,322 | A * | 1/1979 | Lillibridge | 493/240 |
| 4,329,800 | A * | 5/1982 | Shuman | 40/606.14 |
| D277,584 | S * | 2/1985 | Annestedt | D20/43 |
| 4,777,750 | A * | 10/1988 | Garfinkle | 40/607.04 |
| 5,169,226 | A * | 12/1992 | Friedman | 362/190 |
| D382,597 | S * | 8/1997 | Vetro | D20/41 |
| 5,906,064 | A * | 5/1999 | Field | 40/607.11 |
| 6,079,894 | A * | 6/2000 | Obitts | 403/109.3 |
| 6,293,511 | B1 * | 9/2001 | Shepherd | 248/441.1 |
| 7,140,581 | B1 * | 11/2006 | White | 248/129 |
| 2004/0221501 | A1 * | 11/2004 | Schaak et al. | 40/747 |

* cited by examiner

*Primary Examiner* — Casandra Davis
(74) *Attorney, Agent, or Firm* — Bay Area Technology Law Group PC

(57) ABSTRACT

A sign holder device for the support and display of signage. The device includes a base, sign holder and a stem, the stem having a first end appended to the base and a second end supporting the sign holder. The stem has a length defined by the distance between its first and second ends, the length being adjustable to vary the distance between the base and sign holder.

1 Claim, 3 Drawing Sheets

ADJUSTABLE SIGN HOLDER DEVICE

RELATED APPLICATIONS

The present application is a continuation-in-part of U.S. application Ser. No. 11/888,108 filed on Jul. 31, 2007 now U.S. Pat. No. 8,220,189 which is a continuation of U.S. application Ser. No. 10/147,669 filed on Jul. 22, 2002 which is, in turn, a divisional of U.S. application Ser. No. 09/684,726 filed on Oct. 6, 2000 and issued as U.S. Pat. No. 6,530,166 on Mar. 11, 2003.

TECHNICAL FIELD

The present invention is directed to a sign holder device in the form of parts which, upon assembly, provide for the support and display of signage. The sign holder device can be used in a number of environments most notably in retail food establishments and is configured to enable a user to alter a sign's orientation and to enable a sign holder to be vertically raised and lowered through the use of a stem adjustable in length.

BACKGROUND OF THE INVENTION

Retail establishments such as supermarket chains require signage of every imaginable configuration. Every product sold requires some type of sign to inform a consumer of the nature and price of products on display. For example, produce such as oranges, bananas and grapefruit require one type of signage while frozen food bins and deli cases yet others. It is impractical for a multi-product retail establishment such as a grocery chain to inventory preassembled signage for each dedicated orientation. A far better solution is to provide the retailer with an inventory of parts which can be assembled on site depending upon the product display requiring such signage.

The present invention is not the first instance in which it was suggested that retail store signage be provided from a parts bin rather than as assembled members. However, prior knockdown component oriented kits have not been universally embraced by the retail trade for several reasons. Products of this nature of the prior art tend to be flimsy, and not easily assembled and disassembled and oftentimes require a certain level of skill and experience in converting the bin of parts to professionally looking customer-inviting signage. To be successful the parts must be able to assume a wide variety of orientations as retail food displays, from produce to fish to meats and dairy have their own unique signage requirements. Among them is the need to be able to adjust the height of the signage from its supporting base structure. For example, an easel base can be placed upon the surface of an empty display case which is then stacked with oranges, apples or the like in a pyramid fashion. In such an environment, it would be quite important to be able to vertically raise the sign holder sufficiently high to clear the mound of produce to which the sign relates; and to be able to lower the sign as the amount of produce diminishes.

It is thus an object of the present invention to provide a sign holder device having a stem between the base of the device and the sign holder. The stem can be included within a bin of parts to enable it to be employed with bases of various varieties and sign holders of a multitude of configurations. In this regard, reference is made to parent U.S. Pat. No. 6,530,166 disclosing a multitude of bases such as easel bases and those which can be employed between wooden slats and joined to parallel extending wires generally found in refrigerated cases.

To that extent, the disclosure of U.S. Pat. No. 6,530,166 is incorporated herein by reference. The present invention can be employed with each of them.

SUMMARY OF THE INVENTION

A sign holder device for the support and display of signage. The device includes a base, sign holder and a stem, the stem having a first end appended to the base and a second end supporting the sign holder. The stem has a length defined by the distance between its first and second ends, the length being adjustable to vary the distance between the base and sign holder.

DETAILED DESCRIPTION OF THE INVENTION

Figure 1:
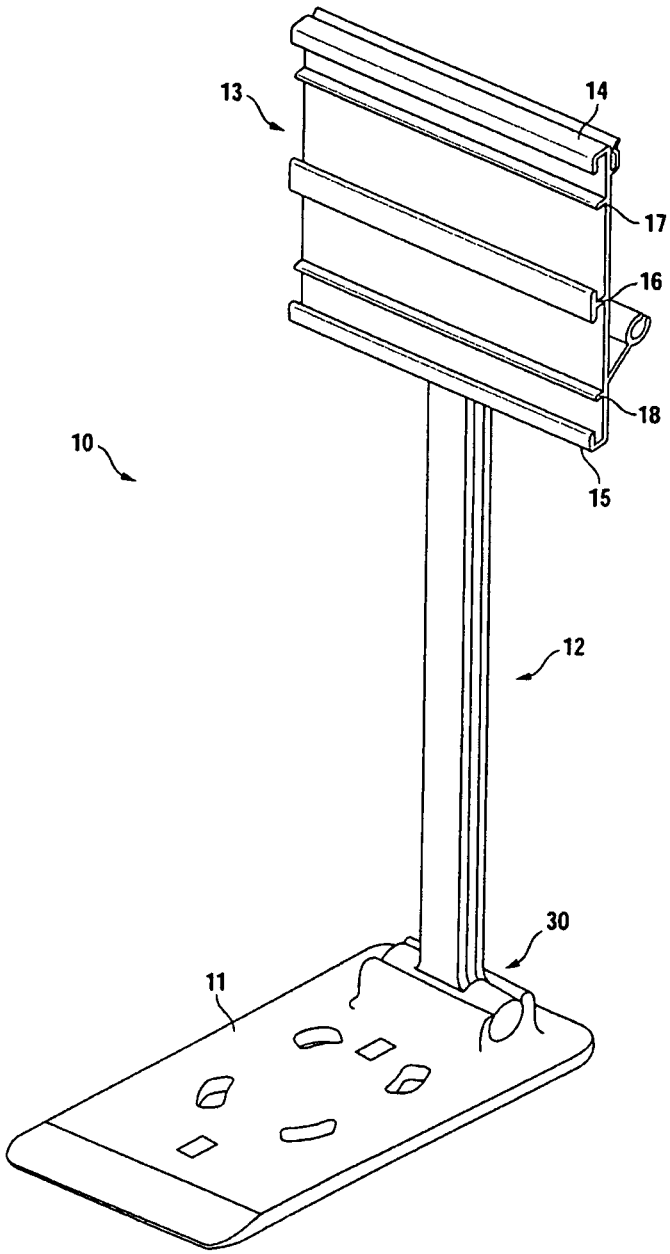
FIG. 1 is a perspective view of a typical sign holder device embracing the inventive concepts of the present invention.

An illustration of the present invention is depicted in FIG. 1. Specifically, sign holder device 10 is shown having base 11 supporting stem 12. In this illustration, base 11 is an easel base although any of the other functional bases commonly employed in retail settings can be used as part of the sign holder device of this invention. Examples of suitable bases are disclosed in applicant's previously issued U.S. Pat. No. 6,530,166, the disclosure of which is incorporated by reference herein.

Figure 3:
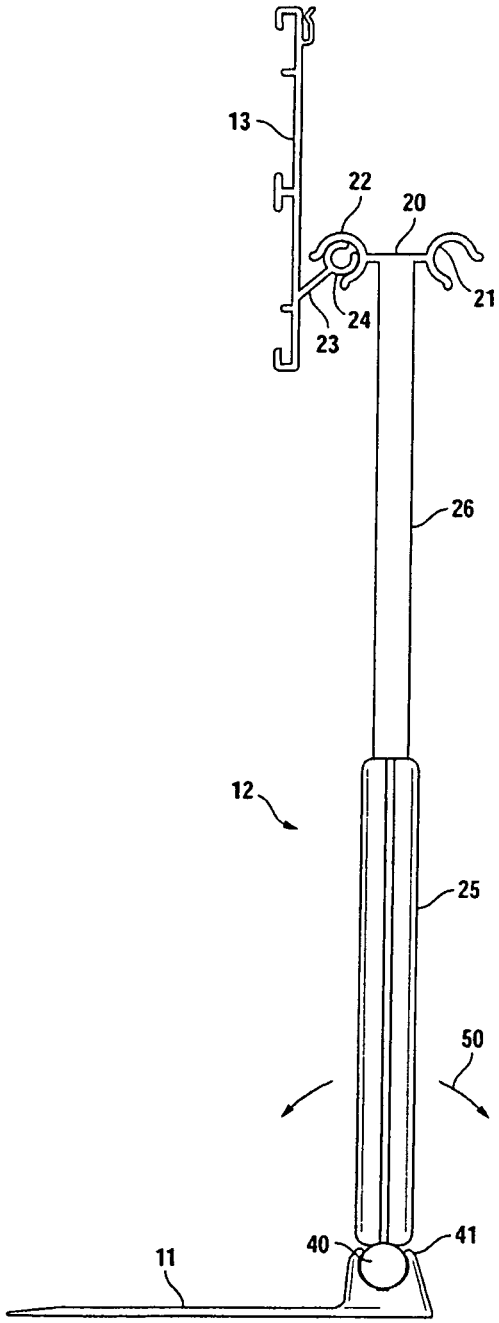

Although the interface between base 11 and stem 12 can take on a number of alternative configurations while remaining within the spirit and scope of the present invention, in the illustration as shown, base 11 incorporates a C-shaped receiving channel 41 sized to frictionally engage cylindrical portion 40 of stem 12 enabling cylindrical portion 40 to rotate therein enhancing the flexibility of the present invention by providing a user the ability to move stem 12 forward and backward in the direction of arrows 50 (FIG. 3).

The configuration of stem 12 represents an important feature of the present invention. Stem 12 has first end 30 appended to base 11 as discussed previously. Second end 20 of stem 12 supports a sign holder such as sign holder 13 illustrated herein. Although sign holder 13 can take on a multitude of physical embodiments, in the illustration as shown, clips 14 and 15 extend at the upper and lower horizontal edges thereof, respectively, to receive product information, such as pricing, when ledge 16 is located between them. Signage, such as pricing and other product information, is slid within the two channels created by this configuration and maintained in a "bowed" configuration by raised portions 17 and 18.

Sign holder 13, in its preferred embodiment, is located proximate second end 20 of stem 12 and is connected thereto by diagonally extending support 23 terminating in cylindrical element 24 which is frictionally received by C-shaped channel 22. As noted in FIGS. 2 and 3, C-shaped channels 22 and 21 can be configured on opposite sides of stem 12 to increase the flexibility of the present invention. In any regard, by employing this illustrated geometry, sign holder 13 can be caused to rotate in the directions of arrow 51 to assist in positioning signage appearing thereon to be directed at the anticipated viewing angle of a consumer.

As noted previously, an important feature of the present invention is employing stem 12 having a length adjustable to vary the distance between the base and sign holder. This greatly enhances the flexibility of the present invention by enabling the present sign holder to be used in a multitude of environments where signage spacing from base to sign holder is to be varied.

Figure 2:
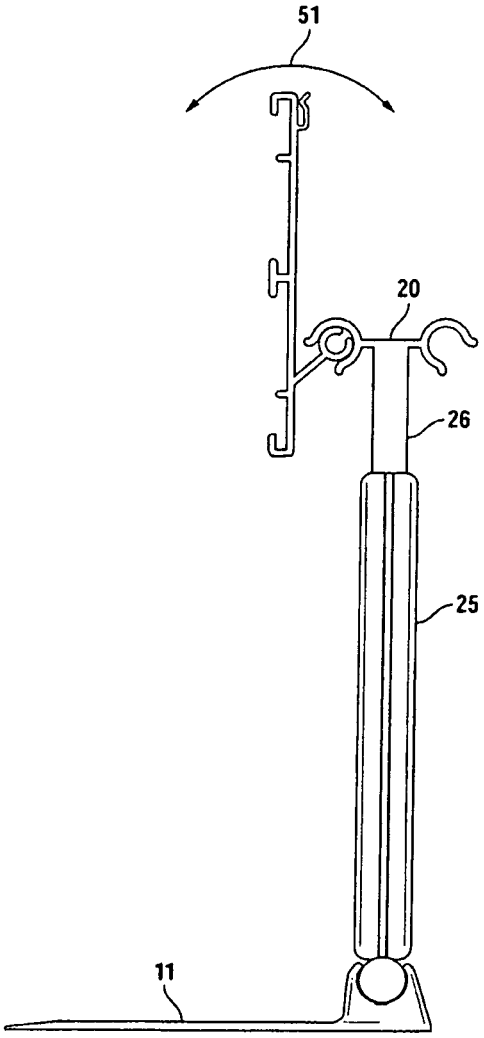
FIGS. 2 and 3 are side views of the sign holder device of FIG. 1 having its stem elevated and retracted as illustrative of the use of the present invention enabling the user to establish varying heights of the sign holder.
Figure 4:
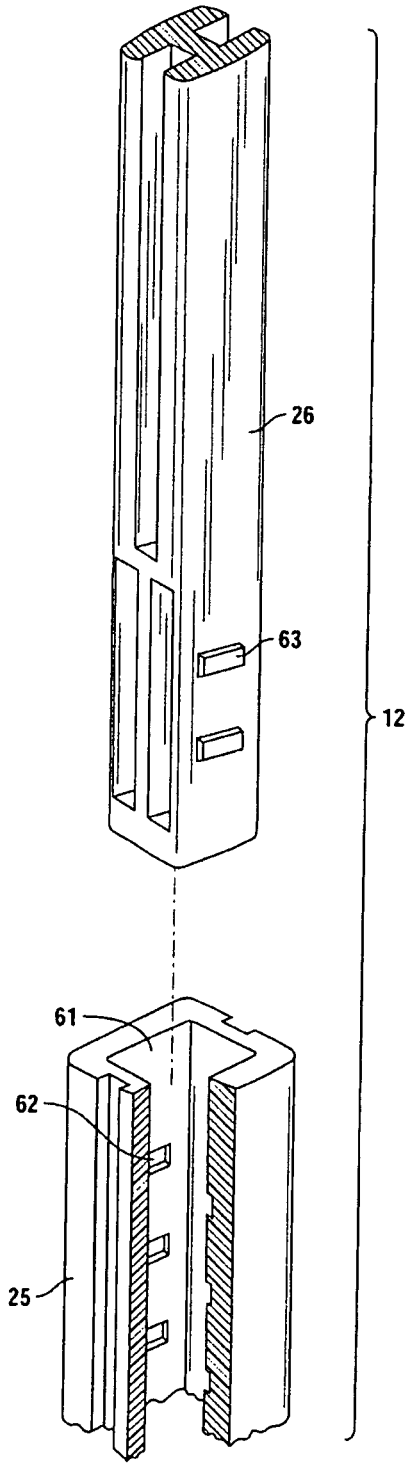
FIG. 4 is a side view showing a portion of the stem of the present invention.

As shown in FIGS. 1-3, stem 12 comprises inner shaft 26 and outer sleeve 25. An illustration of the detail of movement between the inner shaft and outer sleeve is shown in FIG. 4. As illustrated, inner shaft 26 is provided with protrusions 63 positioned as shown on this side wall of shaft 26. Alternatively, protrusions could be configured on outer sleeve 25 with indents 62 configured within inner shaft 26 while remaining within the scope of the present invention. In either case, as inner shaft 26 is moved along outer sleeve 25, inner shaft 26 is caused to fit within space 61 while protrusions snap release along indents to provide a shutter motion as stem 12 is extended or retracted. In doing so, the vertical height of signage 13 can be varied to, again, supplement the flexibility of the present invention.

While various embodiments of the present invention have been shown and described, other modifications thereof are possible while remaining within the scope of the following claims.

What is claimed is:

1. A sign holder device for the support and display of signage, said sign holder device comprising a base, sign holder and stem, said stem having a first end appended to said base and a second end for frictionally supporting the sign holder, such that said sign holder is releasable from said stem by providing lateral force to said sign holder, said stem having a length defined by the distance between said first and second ends, said length being adjustable to vary the distance between said base and sign holder by providing said stem with an inner shaft and outer sleeve, said inner shaft having an outer surface and said outer sleeve having an inner surface, said sign holder device further including at least one protrusion and at least one indent provided for snap-release contact as said inner shaft and outer sleeve moved with respect to one another, said at least one protrusion being either on the outer surface of said inner shaft or inner surface of said outer sleeve while said at least one indent being located on the outer surface of said inner shaft or inner surface of said outer sleeve and wherein said base frictionally captures the first end of said stem, said stem being releasable from said base by providing lateral force to said stem.

* * * * *